US008409773B2

(12) United States Patent
Wu et al.

(10) Patent No.: US 8,409,773 B2
(45) Date of Patent: Apr. 2, 2013

(54) EPOXY CARBOXYL RESIN MIXTURE HOLE BLOCKING LAYER PHOTOCONDUCTORS

(75) Inventors: Jin Wu, Webster, NY (US); Marc J Livecchi, Rochester, NY (US); Robert W Hedrick, Spencerport, NY (US); John J. Wilbert, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 589 days.

(21) Appl. No.: 12/394,343

(22) Filed: Feb. 27, 2009

(65) Prior Publication Data

US 2010/0221651 A1 Sep. 2, 2010

(51) Int. Cl.
*G03G 15/00* (2006.01)

(52) U.S. Cl. ..... 430/58.8; 430/56; 430/69; 430/58.05; 430/59.4

(58) Field of Classification Search ..... 430/109.3, 430/60, 58.5, 108.11, 58.8, 58.05, 59.4
See application file for complete search history.

(56) References Cited

U.S. PATENT DOCUMENTS

| | | | | |
|---|---|---|---|---|
| 5,385,796 | A | 1/1995 | Spiewak et al. | |
| 5,449,573 | A | 9/1995 | Aoki et al. | |
| 5,928,824 | A | 7/1999 | Obinata et al. | |
| 6,015,645 | A | 1/2000 | Murti et al. | |
| 6,156,468 | A | 12/2000 | Wehelie et al. | |
| 6,177,219 | B1 | 1/2001 | Yuh et al. | |
| 6,214,502 | B1 * | 4/2001 | Srinivasan et al. | 430/58.4 |
| 6,255,027 | B1 | 7/2001 | Wehelie et al. | |
| 6,913,863 | B2 | 7/2005 | Wu et al. | |
| 7,037,631 | B2 | 5/2006 | Wu et al. | |
| 7,312,007 | B2 | 12/2007 | Lin et al. | |
| 7,485,398 | B2 | 2/2009 | Wu et al. | |
| 2005/0158640 | A1 * | 7/2005 | Chambers et al. | 430/60 |
| 2006/0105254 | A1 | 5/2006 | Wu et al. | |
| 2006/0204872 | A1 | 9/2006 | Tong et al. | |
| 2007/0049677 | A1 * | 3/2007 | Wu et al. | 524/430 |
| 2007/0243476 | A1 | 10/2007 | Lin et al. | |
| 2007/0298341 | A1 | 12/2007 | Wu et al. | |
| 2008/0008947 | A1 | 1/2008 | Wu | |
| 2008/0008951 | A1 * | 1/2008 | Wu et al. | 430/58.8 |
| 2008/0032219 | A1 | 2/2008 | Lin et al. | |
| 2008/0153023 | A1 * | 6/2008 | Yamazaki et al. | 430/108.11 |
| 2008/0220350 | A1 | 9/2008 | Wu et al. | |
| 2008/0241721 | A1 * | 10/2008 | Yuh et al. | 430/58.8 |
| 2008/0311497 | A1 | 12/2008 | Wu et al. | |
| 2009/0035673 | A1 | 2/2009 | Wu | |
| 2009/0035674 | A1 | 2/2009 | Wu | |
| 2009/0035675 | A1 | 2/2009 | Wu | |
| 2009/0035676 | A1 | 2/2009 | Wu | |
| 2009/0047592 | A1 * | 2/2009 | Okamoto et al. | 430/109.3 |
| 2009/0245867 | A1 * | 10/2009 | Wada et al. | 399/159 |
| 2010/0221649 | A1 | 9/2010 | Wu et al. | |

FOREIGN PATENT DOCUMENTS

| | | | |
|---|---|---|---|
| EP | 1 818 726 | A2 | 8/2007 |
| JP | 2007334335 | A * | 12/2007 |

OTHER PUBLICATIONS

Sep. 6, 2010 European Search Report issued in EP 10 15 3961.
Jin Wu et al., U.S. Application No. on Boron Containing Hole Blocking Layer Photoconductor, filed concurrently herewith.
Jin Wu, U.S. Appl. No. 11/848,439 on Boron Containing Photoconductors, filed May 30, 2008.
Jin Wu et al., U.S. Appl. No. 12/164,338 on Phenolic Resin Hole Blocking Layer Photoconductors, filed May 30, 2008.
Jin Wu, U.S. Appl. No. 12/129,948 on Aminosilane and a Self Crosslinking Acrylic Resin Hole Blocking Layer Photoconductors, filed May 30, 2008.
Jin Wu, U.S. Appl. No. 12/059,536 on Aminosilane and a Carbazole Hole Blocking Layer Photoconductors, filed Mar. 31, 2008.

* cited by examiner

*Primary Examiner* — Mark F Huff
*Assistant Examiner* — Rashid Alam
(74) *Attorney, Agent, or Firm* — Eugene O. Palazzo

(57) ABSTRACT

A photoconductor that includes, for example, a substrate; an undercoat layer thereover wherein the undercoat layer contains a metal oxide, and a mixture of an epoxy resin and a carboxyl resin; a photogenerating layer; and at least one charge transport layer.

25 Claims, No Drawings

EPOXY CARBOXYL RESIN MIXTURE HOLE BLOCKING LAYER PHOTOCONDUCTORS

CROSS REFERENCE TO RELATED APPLICATIONS

U.S. application Ser. No. 12/394,178, U.S. Publication No. 20100221649, filed Feb. 27, 2009 on Boron Containing Hole Blocking Layer Photoconductor, the disclosure of which is totally incorporated herein by reference, illustrates a photoconductor comprising a substrate, a ground plane layer, an undercoat layer thereover wherein the undercoat layer comprises an aminosilane and a boron compound; a photogenerating layer, and a charge transport layer.

Illustrated in U.S. application Ser. No. 11/831,440, U.S. Publication 20090035673, now U.S. Pat. No. 7,871,748, filed Jul. 31, 2007, entitled Iron Containing Hole Blocking Layer Containing Photoconductors, the disclosure of which is totally incorporated herein by reference, is a photoconductor comprising a substrate; an undercoat layer thereover wherein the undercoat layer comprises a metal oxide, and an iron containing compound; a photogenerating layer; and at least one charge transport layer.

Illustrated in U.S. application Ser. No. 11/831,453, U.S. Publication 20090035674, now U.S. Pat. No. 7,670,737, filed Jul. 31, 2007, entitled UV Absorbing Hole Blocking Layer Containing Photoconductors, the disclosure of which is totally incorporated herein by reference, is a photoconductor comprising a substrate; an undercoat layer thereover wherein the undercoat layer comprises a metal oxide, and an ultraviolet light absorber component; a photogenerating layer; and at least one charge transport layer.

Illustrated in U.S. application Ser. No. 11/831,476, U.S. Publication 20090035676, now U.S. Pat. No. 7,851,115, filed Jul. 31, 2007, entitled Iodonium Hole Blocking Layer Photoconductor, the disclosure of which is totally incorporated herein by reference, is a photoconductor comprising a substrate; an undercoat layer thereover wherein the undercoat layer comprises a metal oxide and an iodonium containing compound; a photogenerating layer; and at least one charge transport layer.

Illustrated in U.S. application Ser. No. 11/831,469, U.S. Publication No. 20090035675, now U.S. Pat. No. 7,867,676, filed Jul. 11, 2007, entitled Copper Containing Hole Blocking Layer Photoconductors, the disclosure of which is totally incorporated herein by reference, is a photoconductor comprising a substrate; an undercoat layer thereover wherein the undercoat layer comprises a metal oxide, and a copper containing compound; a photogenerating layer; and at least one charge transport layer.

Illustrated in U.S. application Ser. No. 11/211,757, U.S. Publication No. 20070049677, now U.S. Pat. No. 7,544,452, filed Aug. 26, 2005, entitled Thick Electrophotographic Imaging Member Undercoat Layers, the disclosure of which is totally incorporated herein by reference, are binders containing metal oxide nanoparticles and a co-resin of phenolic resin and aminoplast resin, and an electrophotographic imaging member undercoat layer containing the binders.

Illustrated in U.S. application Ser. No. 10/942,277, U.S. Publication No. 20060057480, U.S. Pat. No. 7,312,007, filed Sep. 16, 2004, entitled Photoconductive Imaging Members, the disclosure of which is totally incorporated herein by reference, is a photoconductive member containing a hole blocking layer, a photogenerating layer, and a charge transport layer, and wherein the hole blocking layer contains a metallic component like a titanium oxide and a polymeric binder.

Illustrated in U.S. application Ser. No. 11/764,489, U.S. Publication 20080311497, now U.S. Pat. No. 7,846,628, filed Jun. 18, 2007, entitled Hole Blocking Layer Containing Photoconductors, the disclosure of which is totally incorporated herein by reference, is a photoconductor comprising a substrate; an undercoat layer thereover wherein the undercoat layer comprises a metal oxide, an electron donor and an electron acceptor charge transfer complex; a photogenerating layer; and at least one charge transport layer.

Illustrated in U.S. application Ser. No. 11/403,981, U.S. Publication 20070243476, now U.S. Pat. No. 7,604,914, filed Apr. 13, 2006, entitled Imaging Members, the disclosure of which is totally incorporated herein by reference, is an electrophotographic imaging member, comprising a substrate, an undercoat layer disposed on the substrate, wherein the undercoat layer comprises a polyol resin, an aminoplast resin, and a metal oxide dispersed therein; and at least one imaging layer formed on the undercoat layer, and wherein the polyol resin is, for example, selected from the group consisting of acrylic polyols, polyglycols, polyglycerols, and mixtures thereof.

Illustrated in U.S. patent application Ser. No. 11/481,642, U.S. Publication 20080008947, now U.S. Pat. No. 7,732,112, filed Jul. 6, 2006, the disclosure of which is totally incorporated by reference herein, is an imaging member including a substrate; a charge generation layer positioned on the substrate; at least one charge transport layer positioned on the charge generation layer; and an undercoat or hole blocking layer positioned on the substrate on a side opposite the charge generation layer, the undercoat layer comprising a binder component and a metallic component comprising a metal thiocyanate and metal oxide.

Disclosed in U.S. application Ser. No. 11/496,790, U.S. Publication 20080032219, now U.S. Pat. No. 7,560,208, filed Aug. 1, 2006, the disclosure of which is totally incorporated herein by reference, is a photoconductor member comprising a substrate; an undercoat layer thereover wherein the undercoat layer comprises a polyol resin, an aminoplast resin, a polyester adhesion component and a metal oxide; and at least one imaging layer formed on the undercoat layer.

Disclosed in U.S. application Ser. No. 11/714,600, U.S. Publication No. 20080220350, now U.S. Pat. No. 7,579,126, filed Mar. 6, 2007, the disclosure of which is totally incorporated herein by reference, is a photoconductor comprising a substrate; an undercoat layer thereover wherein the undercoat layer comprises an electroconducting component dispersed in a rapid curing polymer matrix; a photogenerating layer, and at least one charge transport layer.

The appropriate components and processes, number and sequence of the layers, component and component amounts in each layer, and the thicknesses of each layer of the above copending applications, may be selected for the present disclosure photoconductors in embodiments thereof.

BACKGROUND

There are disclosed herein hole blocking layers, and more specifically, photoconductors containing a hole blocking layer or undercoat layer (UCL) comprised, for example, of a metal oxide, and a mixture of an epoxy resin and a carboxyl resin, and which layer can be situated between the supporting substrate and the photogenerating layer. More specifically, there are disclosed herein an epoxy and carboxyl resin mixture containing undercoat or hole blocking layers which further include some of the components as illustrated in the copending applications referred to herein, such as a metal oxide like a titanium dioxide.

In embodiments, photoconductors comprised of the disclosed hole blocking or undercoat layer enables, for example, the minimization or substantial elimination of undesirable ghosting on developed images, such as xerographic images, including excellent ghosting at various relative humidities; excellent cyclic and stable electrical properties; minimal charge deficient spots (CDS); and compatibility with the photogenerating and charge transport resin binders, such as polycarbonates. Charge blocking layer and hole blocking layer are generally used interchangeably with the phrase "undercoat layer".

The need for excellent print quality in xerographic systems is of value, especially with the advent of color. Common print quality issues can be dependent on the components of the undercoat layer (UCL). In certain situations, a thicker undercoat is desirable, but the thickness of the material used for the undercoat layer may be limited by, in some instances, the inefficient transport of the photoinjected electrons from the generator layer to the substrate. When the undercoat layer is too thin, then incomplete coverage of the substrate may sometimes result due to wetting problems on localized unclean substrate surface areas. The incomplete coverage produces pin holes which can, in turn, produce print defects such as charge deficient spots (CDS) and bias charge roll (BCR) leakage breakdown. Other problems include "ghosting" resulting from, it is believed, the accumulation of charge somewhere in the photoreceptor. Removing trapped electrons and holes residing in the imaging members is a factor to preventing ghosting. During the exposure and development stages of xerographic cycles, the trapped electrons are mainly at or near the interface between the photogenerating layer (CGL) and the undercoat layer (UCL), and holes are present mainly at or near the interface between the photogenerating layer and the charge transport layer (CTL). The trapped charges can migrate according to the electric field during the transfer stage where the electrons can move from the interface of CGL/UCL to CTL/CGL, or the holes from CTL/CGL to CGL/UCL, and become deep traps that are no longer mobile. Consequently, when a sequential image is printed, the accumulated charge results in image density changes in the current printed image that reveals the previously printed image. Thus, there is a need to minimize or eliminate charge accumulation in photoreceptors without sacrificing the desired thickness of the undercoat layer, and a need for permitting the UCL to properly adhere to the other photoconductive layers, such as the photogenerating layer, for extended time periods, such as for example, about 2,000,000 simulated xerographic imaging cycles. Thus, conventional materials used for the undercoat or blocking layer possess a number of disadvantages resulting in adverse print quality characteristics, which disadvantages include, for example, ghosting, charge deficient spots, and bias charge roll leakage breakdown are problems that commonly occur. Ghosting, it is believed, results from the accumulation of charge in the photoconductor, therefore, when a sequential xerographic image is printed, the accumulated charge results in image density changes that reveals the previously printed image.

Thick undercoat layers are sometimes desirable for xerographic photoconductors as such layers permit photoconductor life extension and carbon fiber resistance. Furthermore, thicker undercoat layers permit the use of economical substrates in the photoreceptors. Examples of thick undercoat layers are disclosed in U.S. application Ser. No. 10/942,277, filed Sep. 16, 2004, U.S. Publication 20060057480, entitled Photoconductive Imaging Members, the entire disclosure of which is totally incorporated herein by reference. However, due primarily to insufficient electron conductivity in dry and cold environments, the residual potential in conditions, such as 10 percent relative humidity and 70° F., can be high when the undercoat layer is thicker than about 15 microns, and moreover, the adhesion of the UCL may be poor, disadvantages avoided or minimized with the UCL of the present disclosure.

Also included within the scope of the present disclosure are methods of imaging and printing with the photoconductive devices illustrated herein. These methods generally involve the formation of an electrostatic latent image on the imaging member, followed by developing the image with a toner composition comprised, for example, of a thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members, photoconductor drums, and flexible belts disclosed herein can be selected for the Xerox Corporation iGEN3® machines that generate with some versions over 100 copies per minute. Processes of imaging, especially xerographic imaging and printing, including digital, and/or high speed color printing, are thus encompassed by the present disclosure.

The photoconductors disclosed herein are, in embodiments, sensitive in the wavelength region of, for example, from about 400 to about 900 nanometers, and in particular from about 650 to about 850 nanometers, thus diode lasers can be selected as the light source.

REFERENCES

Illustrated in U.S. Pat. No. 6,913,863 is a photoconductive imaging member comprised of an optional supporting substrate, a hole blocking layer thereover, a photogenerating layer, and a charge transport layer, and wherein the hole blocking layer is comprised of a metal oxide, a mixture of phenolic resins, and wherein at least one of the resins contains two hydroxy groups.

Illustrated in U.S. Pat. Nos. 6,255,027; 6,177,219, and 6,156,468, are, for example, photoreceptors containing a charge blocking layer of a plurality of light scattering particles dispersed in a binder, reference for example, Example I of U.S. Pat. No. 6,156,468, wherein there is illustrated a charge blocking layer of titanium dioxide dispersed in a specific linear phenolic binder of VARCUM®, available from OxyChem Company.

Illustrated in U.S. Pat. No. 6,015,645, is a photoconductive imaging member comprised of a supporting substrate, a hole blocking layer, an optional adhesive layer, a photogenerating layer, and a charge transport layer, and wherein the blocking layer is comprised of a polyhaloalkylstyrene.

Layered photoconductors have been described in numerous U.S. patents, such as U.S. Pat. No. 4,265,990.

In U.S. Pat. No. 4,921,769, there are illustrated photoconductive imaging members with blocking layers of certain polyurethanes.

Illustrated in U.S. Pat. No. 5,473,064, the disclosure of which is totally incorporated herein by reference, is a process for the preparation of hydroxygallium phthalocyanine Type V, essentially free of chlorine.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

A number of photoconductors are disclosed in U.S. Pat. Nos. 5,489,496; 4,579,801; 4,518,669; 4,775,605; ; 5,641,599; 5,344,734; 5,721,080; and U.S. Pat. No. 5,017,449, the entire disclosures of which are totally incorporated herein by reference. Also, photoreceptors are disclosed in U.S. Pat. Nos. 6,200,716; 6,180,309; and U.S. Pat. No. 6,207,334, the entire disclosures of which are totally incorporated herein by reference.

A number of undercoat or charge blocking layers are disclosed in U.S. Pat. Nos. 4,464,450; 5,449,573; 5,385,796; and U.S. Pat. No. 5,928,824, the entire disclosures of which are totally incorporated herein by reference.

SUMMARY

According to embodiments illustrated herein, there are provided photoconductors that enable acceptable print quality, and wherein ghosting is minimized or substantially eliminated in images printed in systems with high transfer current, and where charge deficient spots (CDS) resulting, for example, from the photogenerating layer, and causing printable defects is minimized, and more specifically, where the CDSs are low, such as from about 30 to about 90 percent lower as compared to a similar photoconductor with a known hole blocking layer.

Embodiments disclosed herein also include a photoconductor comprising a substrate, an undercoat layer as illustrated herein, disposed or deposited on the substrate, and a photogenerating layer and charge transport layer formed on the undercoat layer; a photoconductor comprised of a substrate, an undercoat layer disposed on the substrate, wherein the undercoat layer comprises a metal oxide like titanium dioxide, and a mixture of an epoxy resin and a carboxyl resin which primarily functions to inhibit ghosting characteristics for the photoconductor.

DETAILED DESCRIPTION

Aspects of the present disclosure relate to a photoconductor comprising a substrate; an undercoat layer thereover wherein the undercoat layer comprises a metal oxide, and a mixture of an epoxy resin and a carboxyl resin; a photogenerating layer; and at least one charge transport layer; a photoconductor comprising a supporting substrate; an undercoat layer thereover comprised of a mixture of a metal oxide, and a mixture of an epoxy resin and a carboxyl resin; a photogenerating layer; and a charge transport layer; a rigid or flexible photoconductor comprising in sequence a supporting substrate; a hole blocking layer comprised, for example, of a titanium oxide, and a mixture of an epoxy resin and a carboxyl resin; a photogenerating layer; and a charge transport layer; a photoconductive member or device comprising a substrate, the robust undercoat layer illustrated herein, and at least one imaging layer, such as a photogenerating layer and a charge transport layer or layers, formed on the undercoat layer; a photoconductor wherein the photogenerating layer is situated between the charge transport layer and the substrate, and which layer contains a resin binder; an electrophotographic imaging member which generally comprises at least a substrate layer, an undercoat layer, and where the undercoat layer is generally located between the substrate and deposited on the undercoat layer in sequence a photogenerating layer and a charge transport layer; a photoconductor comprising a substrate; an undercoat layer thereover wherein the undercoat layer comprises a metal oxide, and a mixture of the resins illustrated herein; a photogenerating layer; and at least one charge transport layer; a photoconductor comprising a substrate, an undercoat layer thereover comprised of a mixture of a metal oxide, an epoxy resin, and a carboxyl resin; a photogenerating layer; and a charge transport layer; and a rigid or flexible photoconductor comprising in sequence a supporting substrate; a resin mixture metal oxide hole blocking layer; a photogenerating layer; and at least one charge transport layer.

In embodiments, the undercoat layer metal oxide like $TiO_2$ can be either surface treated or untreated. Surface treatments include, but are not limited to, mixing the metal oxide with aluminum laurate, alumina, zirconia, silica, silane, methicone, dimethicone, sodium metaphosphate, and the like, and mixtures thereof. Examples of $TiO_2$ include MT-150W™ (surface treatment with sodium metaphosphate, available from Tayca Corporation), STR-60N™ (no surface treatment, available from Sakai Chemical Industry Co., Ltd.), FTL-100™ surface treatment, available from Ishihara Sangyo Laisha, Ltd.), STR-60™ (surface treatment with $Al_2O_3$, available from Sakai Chemical Industry Co., Ltd.), TTO-55N™ (no surface treatment, available from Ishihara Sangyo Laisha, Ltd.), TTO-55A™ (surface treatment with $Al_{2O3}$, available from Ishihara Sangyo Laisha, Ltd.), MT-150AW™ (no surface treatment, available from Tayca Corporation), MT-150A™ (no surface treatment, available from Tayca Corporation), MT-100S™ (surface treatment with aluminum laurate and alumina, available from Tayca Corporation), MT-100HD™ (surface treatment with zirconia and alumina, available from Tayca Corporation), MT-100SA™ (surface treatment with silica and alumina, available from Tayca Corporation), and the like.

Examples of metal oxides present in suitable amounts, such as for example, from about 5 to about 80 weight percent, and more specifically, from about 40 to about 70 weight percent, are titanium oxides and mixtures of metal oxides thereof. In embodiments, the metal oxide has a size diameter of from about 5 to about 300 nanometers, a powder resistance of from about $1\times10^3$ to about $6\times10^5$ ohm/cm when applied at a pressure of from about 50 to about 650 kilograms/$cm^2$, and yet more specifically, the titanium oxide possesses a primary particle size diameter of from about 10 to about 25 nanometers, and more specifically, from about 12 to about 17, and yet more specifically, about 15 nanometers with an estimated aspect ratio of from about 4 to about 5, and is optionally surface treated with, for example, a component containing, for example, from about 1 to about 3 percent by weight of alkali metal, such as a sodium metaphosphate, a powder resistance of from about $1\times10^4$ to about $6\times10^4$ ohm/cm when applied at a pressure of from about 650 to about 50 kilograms/$cm^2$; MT-150W™, and which titanium oxide is available from Tayca Corporation, and wherein the hole blocking layer is of a suitable thickness, such as a thickness of about from about 0.1 to about 15 microns, thereby avoiding or minimizing charge leakage. Metal oxide examples in addition to titanium are chromium, zinc, tin, copper, antimony, and the like, and more specifically, zinc oxide, tin oxide, aluminum oxide, silicone oxide, zirconium oxide, indium oxide, molybdenum oxide, and mixtures thereof.

NONLIMITING EXAMPLES OF RESIN MIXTURES

Specific nonlimiting examples of the epoxy resin are diglycidyl ether of bisphenol A, diglycidyl ether of bisphenol F resins and modified resins and blends thereof.

Specific diglycidyl ether of bisphenol A liquid epoxy resins include EPON™ 825 (175 to 180 weight per epoxide), 834 (230 to 280 weight per epoxide), 824 (192 to 204 weight per epoxide), 8280 (185 to 195 weight per epoxide), and 872 (625 to 725 weight per epoxide). Specific diglycidyl ether of bisphenol F liquid epoxy resins include EPON™ 862 (165 to 173 weight per epoxide), and 863 (165 to 174 weight per epoxide). Specific diglycidyl ether of bisphenol F and bisphenol A blend liquid epoxy resins include EPON™ 235 (177 to 182 weight per epoxide), all commercially available from HEXION Specialty Chemicals, Columbus, Ohio. These liquid epoxy resins can be further blended with alkyl glycidyl ether as in EPON™ 8132, cresyl glycidyl ether as in EPON™ 813, butyl glycidyl ether as in EPON™ 815C, castor oil glycidyl ether as in EPON™ 8131, and other glycidyl ethers, all commercially available from HEXION Specialty Chemicals, Columbus, Ohio.

Epoxy resins can also be in solutions in solvents, such as acetone, methyl ethyl ketone, methyl isobutyl ketone (MIBK), diacetone alcohol, isopropyl alcohol, n-butyl alcohol, n-butyl acetate, propylene glycol monomethyl ether, isobutyl alcohol, ethyl 3-ethoxypropionate, t-butyl acetate, propylene glycol mono(n-butyl)ether, ethylene glycol monobutyl ether, methyl n-amyl ketone, n-propyl alcohol, propylene glycol monomethyl ether acetate, dimethylformamide, cyclohexanone, toluene, aromatic 100, dipropylene glycol monomethyl ether, water, xylene, ethylene glycol monopropyl ether, and the like, and mixtures thereof.

Specific diglycidyl ether of bisphenol A solution epoxy resins include EPON™ 828-X-95 (193 to 204 weight per epoxide, 95 percent solids in xylene), 8521-MX-60 (750 to 850 weight per epoxide, 60 percent solids in ethylene glycol monobutyl ether/xylene), 1001-T-75 (450 to 550 weight per epoxide, 75 percent solids in toluene), 1004-O-65 (850 to 1,050 weight per epoxide, 65 percent solids in methyl n-amyl ketone), 1007-CT-55 (1,600 to 2,300 weight per epoxide, 55 percent solids in MIBK/toluene), and 1009-MV-40 (2,500 to 4,000 weight per epoxide, 40 percent solids in ethylene glycol monobutyl ether/dipropylene glycol monomethyl ether), all commercially available from HEXION Specialty Chemicals, Columbus, Ohio. These solution epoxy resins can be further blended with alkyl C12 to C14 glycidyl ether as in EPON™ CS 243, and p-tert-butyl phenyl glycidyl ether as in EPON™ CS 377, all commercially available from HEXION Specialty Chemicals, Columbus, Ohio.

Other epoxy resins that can be selected as part of the resin mixture hole blocking layer include tetraglycidyl ether of tetraphenol ethane resins such as EPON™ 1031 (195 to 230 weight per epoxide), epoxy phenolic novolac resins such as EPON™ 154 (176 to 181 weight per epoxide), epoxy bisphenol A novolac resins such as EPON™ SU-2.5 (180 to 200 weight per epoxide), epoxy bisphenol F novolac resins such as EPON™ 160 (168 to 178 weight per epoxide), epoxy cresol novolac resins such as EPON™ 164 (200 to 240 weight per epoxide), epoxy polyacrylates such as EPON™ 8111 (140 weight per epoxide), elastomer modified epoxy resins such as EPON™ 58005 (325 to 375 weight per epoxide), hydrogenated diglycidyl ether of bisphenol A (cycloaliphatic glycidyl ether) resins such as EPONEX™ 1510 (210 to 220 weight per epoxide), and brominated epoxy resins such as EPON™ 1183 (625 to 725 weight per epoxide), all commercially available from HEXION Specialty Chemicals, Columbus, Ohio.

The epoxy resins possess, for example, a number average molecular weight of from about 50 to about 10,000, from about 200 to about 4,000, or from about 400 to about 1,000, and a weight average molecular weight of from about 60 to about 30,000, from about 250 to about 12,000, or from about 500 to about 3,000, present in an amount of from about 5 to about 90 weight percent, or from about 10 to about 40 weight percent of the total hole blocking layer solids.

Specific nonlimiting examples of the carboxyl resin are acrylic carboxyl resins. In embodiments, acrylic carboxyl resin examples include copolymers of acrylic acid and/or methacrylic acid, and/or their derivatives including acrylic and methacrylic esters and components containing nitrile and amide groups, and other optional monomers. The acrylic esters can be selected from, for example, the group consisting of n-alkyl acrylates wherein alky contains, in embodiments, from 1 to about 25 carbon atoms, such as methyl, ethyl, propyl, butyl, pentyl, hexyl, heptyl, octyl, nonyl, decyl, dodecyl, tetradecyl, or hexadecyl acrylate; secondary and branched-chain alkyl acrylates such as isopropyl, isobutyl, sec-butyl, 2-ethylhexyl, or 2-ethylbutyl acrylate; olefinic acrylates such as allyl, 2-methylallyl, furfuryl, or 2-butenyl acrylate; aminoalkyl acrylates such as 2-(dimethylamino) ethyl, 2-(diethylamino)ethyl, 2-(dibutylamino)ethyl, or 3-(diethylamino)propyl acrylate; ether acrylates such as 2-methoxyethyl, 2-ethoxyethyl, tetrahydrofurfuryl, or 2-butoxyethyl acrylate; cycloalkyl acrylates such as cyclohexyl, 4-methylcyclohexyl, or 3,3,5-trimethylcyclohexyl acrylate; halogenated alkyl acrylates such as 2-bromoethyl, 2-chloroethyl, or 2,3-dibromopropyl acrylate; glycol acrylates and diacrylates such as ethylene glycol, propylene glycol, 1,3-propanediol, 1,4-butanediol, diethylene glycol, 1,5-pentanediol, triethylene glycol, dipropylene glycol, 2,5-hexanediol, 2,2-diethyl-1,3-propanediol, 2-ethyl-1,3-hexanediol, or 1,10-decanediol acrylate, and diacrylate. Examples of methacrylic esters can be selected from, for example, the group consisting of alkyl methacrylates such as methyl, ethyl, propyl, isopropyl, n-butyl, isobutyl, sec-butyl, t-butyl, n-hexyl, n-octyl, isooctyl, 2-ethylhexyl, n-decyl, or tetradecyl methacrylate; unsaturated alkyl methacrylates such as vinyl, allyl, oleyl, or 2-propynyl methacrylate; cycloalkyl methacrylates such as cyclohexyl, 1-methylcyclohexyl, 3-vinylcyclohexyl, 3,3,5-trimethylcyclohexyl, bornyl, isobornyl, or cyclopenta-2,4-dienyl methacrylate; aryl methacrylates such as phenyl, benzyl, or nonylphenyl methacrylate; hydroxyalkyl methacrylates such as 2-hydroxyethyl, 2-hydroxypropyl, 3-hydroxypropyl, or 3,4-dihydroxybutyl methacrylate; ether methacrylates such as methoxymethyl, ethoxymethyl, 2-ethoxyethoxymethyl, allyloxymethyl, benzyloxymethyl, cyclohexyloxymethyl, 1-ethoxyethyl, 2-ethoxyethyl, 2-butoxyethyl, 1-methyl-(2-vinyloxy)ethyl, methoxymethoxyethyl, methoxyethoxyethyl, vinyloxyethoxyethyl, 1-butoxypropyl, 1-ethoxybutyl, tetrahydrofurfuryl, or furfuryl methacrylate; oxiranyl methacrylates such as glycidyl, 2,3-epoxybutyl, 3,4-epoxybutyl, 2,3-epoxycyclohexyl, or 10,11-epoxyundecyl methacrylate; aminoalkyl methacrylates such as 2-dimethylaminoethyl, 2-diethylaminoethyl, 2-t-octylaminoethyl, N,N-dibutylaminoethyl, 3-diethylaminopropyl, 7-amino-3,4-dimethyloctyl, N-methylformamidoethyl, or 2-ureidoethyl methacrylate; glycol dimethacrylates such as methylene, ethylene glycol, 1,2-propanediol, 1,3-butanediol, 1,4-butanediol, 2,5-dimethyl-1,6-hexanediol, 1,10-decanediol, diethylene glycol, or triethylene glycol dimethacrylate; trimethacrylates such as trimethylolpropane trimethacrylate; carbonyl-containing methacrylates such as carboxymethyl, 2-carboxyethyl, acetonyl, oxazolidinylethyl, N-(2-methacryloyloxyethyl)-2-pyrrolidinone, N-methacryloyl-2-pyrrolidinone, N-(metharyloyloxy)formamide, N-methacryloylmorpholine, or tris(2-methacryloxyethyl)amine methacrylate; other nitrogen-containing methacrylates such as 2-methacryloyloxyethylmethyl cyanamide, methacryloyloxyethyltrimethylammonium chloride, N-(methacryloyloxy-ethyl)diisobutylketimine, cyanomethyl, or 2-cyanoethyl methacrylate; halogenated alkyl methacrylates such as chloromethyl, 1,3-dichloro-2-propyl, 4-bromophenyl, 2-bromoethyl, 2,3-dibromopropyl, or 2-iodoethyl methacrylate; sulfur-containing methacrylates such as methylthiol, butylthiol, ethylsulfonylethyl, ethylsulfinylethyl, thiocyanatomethyl, 4-thiocyanatobutyl, methylsulfinylmethyl, 2-dodecylthioethyl methacrylate, or bis(methacryloyloxyethyl)sulfide; phosphorous-boron-silicon-containing methacrylates such as 2-(ethylenephosphino)propyl, dimethylphosphinomethyl, dimethylphosphonoethyl, diethylphosphatoethyl, 2-(dimethylphosphato)propyl, 2-(dibutylphosphono)ethyl methacrylate, diethyl methacryloylphosphonate, dipropyl methacryloyl phosphate, diethyl methacryloyl phosphite, 2-methacryloyloxyethyl diethyl phosphite, 2,3-butylene methacryloyloxyethyl borate, or methyldiethoxymethacryloyloxyethoxysilane. Methacrylic amides and nitriles can be selected from the group consisting of at least one of N-methylmethacrylamide, N-isopropylmethacrylamide, N-phenylmethacrylamide, N-(2-hydoxyethyl)methacrylamide, 1-methacryloylamido-2-methyl-2-propanol, 4-methacryloylamido-4-methyl-2-pentanol, N-(methoxymethyl)methacrylamide, N-(dimethylaminoethyl)methacrylamide, N-(3-dimethylaminopropyl)methacrylamide, N-acetylmethacrylamide, N-methacryloylmalemic acid, methacryloylamido acetonitrile, N-(2-cyanoethyl) methacrylamide, 1-methacryloylurea, N-phenyl-N-phenylethylmethacrylamide, N-(3-dibutylaminopropyl)methacrylamide, N,N-diethylmethacrylamide, N-(2-cyanoethyl)-N-methylmethacrylamide, N,N-bis(2-diethylaminoethyl) methacrylamide, N-methyl-N-phenylmethacrylamide, N,N'-methylenebismethacrylamide, N,N'-ethylenebismethacrylamide, or N-(diethylphosphono) methacrylamide. Further optional monomer examples are styrene, acrolein, acrylic anhydride, acrylonitrile, acryloyl chloride, methacrolein, methacrylonitrile, methacrylic anhydride, methacrylic acetic anhydride, methacryloyl chloride, methacryloyl bromide, itaconic acid, butadiene, vinyl chloride, vinylidene chloride, or vinyl acetate.

Specific acrylic carboxyl resin examples include PARALOID® AT-85 ($T_g$=9° C., acid number=65, 55.5 percent solid in aromatic 150/butyl cellusolve=87/13), PARALOID® AT-81 ($T_g$=40° C., acid number=65, 55.5 percent solid in aromatic 150/butyl cellusolve=87/13), PARALOID® AT-76 ($T_g$=25° C., acid number=38, 41 percent solid in aromatic 150/butyl cellusolve=75/25), PARALOID® AT-148 ($T_g$=9° C., acid number=65, 55 percent solid in butyl cellusolve), PARALOID® AT-147 ($T_g$=40° C., acid number=65, 55 percent solid in butyl cellusolve), and PARALOID® AT-9LO ($T_g$=30° C., acid number=35, 45 percent solid in aromatic 150/butyl cellusolve=90/10), all commercially available from Rohm and Haas.

The number average molecular weight of the carboxyl resin is, for example, from about 400 to about 50,000, or from about 1,000 to about 10,000. The weight average molecular weight of the carboxyl resin is from about 500 to about 100,000, or from about 1,500 to about 20,000. The carboxyl resin is present in an amount of from about 5 to about 90 weight percent, or from about 10 to about 40 weight percent of the total hole blocking layer solids.

The hole blocking layer further comprises an acid catalyst or a base catalyst to accelerate the crosslinking reactions between the two resins. Non-limiting examples of the acid catalyst include oxalic acid, maleic acid, carboxylic acid, ascorbic acid, malonic acid, succinic acid, tartaric acid, citric acid, p-toluenesulfonic acid, methanesulfonic acid, and the like, and mixtures thereof. A typical concentration of the acid catalyst is from about 0.1 to about 5 weight percent or from about 0.5 to about 2 weight percent based on the total weight of the two resins. Non-limiting examples of the base catalyst are amines, such as triethyl amine, diethylenetriamine, triethylenetetramine, isphoronediamine, bis-p-aminocyclohexyl methane, 1,2-diaminocyclohexane, diaminodiphenylmethane, and the like, and the mixtures thereof. A typical concentration of the base catalyst is from about 0.1 to about 10 weight percent, or from about 0.5 to about 4 weight percent based on the total weight of the two resins.

Examples of amounts of the resin mixture that is present in the hole blocking layer can vary, and be, for example, from about 10 to about 95 weight percent, from about 20 to about 60 weight percent, and more specifically, from about 30 to about 40 weight percent, based on the weight percentages of the components contained in the hole blocking layer.

The weight ratio of the epoxy resin and the carboxyl resin of the resin mixture is from about 10/90 to about 90/10, from about 20/80 to about 80/20, or from about 40/60 to about 60/40.

The hole blocking layer can, in embodiments, be prepared by a number of known methods, the process parameters being dependent, for example, on the photoconductor member desired. The hole blocking layer can be coated as a dispersion onto a substrate by the use of a spray coater, dip coater, extrusion coater, roller coater, wire-bar coater, slot coater, doctor blade coater, gravure coater, and the like, and dried at from about 40° C. to about 240° C., or from about 140° C. to about 200° C. for a suitable period of time, such as from about 1 minute to about 10 hours, or from about 10 to about 60 minutes, under stationary conditions or in an air flow. The coating can be accomplished to provide a final coating thickness of from about 0.1 to about 30 microns, from about 1 to about 20 microns, or from about 5 to about 15 microns after drying.

In embodiments, the hole blocking layer may contain various colorants such as organic pigments and organic dyes, including, but not limited to, azo pigments, quinoline pigments, perylene pigments, indigo pigments, thioindigo pigments, bisbenzimidazole pigments, phthalocyanine pigments, quinacridone pigments, quinoline pigments, lake pigments, azo lake pigments, anthraquinone pigments, oxazine pigments, dioxazine pigments, triphenylmethane pigments, azulenium dyes, squalium dyes, pyrylium dyes, triallylmethane dyes, xanthene dyes, thiazine dyes, and cyanine dyes. In various embodiments, the hole blocking layer may include inorganic materials, such as amorphous silicon, amorphous selenium, tellurium, a selenium-tellurium alloy, cadmium sulfide, antimony sulfide, titanium oxide, tin oxide, zinc oxide, and zinc sulfide, and mixtures thereof. The colorant can be selected in various suitable amounts like from about 0.5 to about 20 weight percent, and more specifically, from 1 to about 12 weight percent.

In various embodiments, the hole blocking layer further contains an optional light scattering particle. In various embodiments, the light scattering particle has a refractive index different from the resin mixture, and has a number average particle size greater than about 0.8 micron. The light scattering particle can be amorphous silica, and silicone ball. In various embodiments, the light scattering particle can be present in an amount of about 0 to about 10 percent by weight of a total weight of the hole blocking layer.

PHOTOCONDUCTOR LAYER EXAMPLES

The thickness of the photoconductive substrate layer depends on many factors including economical considerations, electrical characteristics, and the like; thus, this layer may be of substantial thickness, for example over 3,000 microns, such as from about 500 to about 2,000 microns, from about 300 to about 700 microns, or of a minimum thickness. In embodiments, the thickness of this layer is from about 75 to about 300 microns, or from about 100 to about 150 microns.

The substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors including strength desired and economical considerations. For a drum, as disclosed in a copending application referenced herein, this layer may be of a substantial thickness of, for example, up to many centimeters or of a minimum thickness of less than a millimeter. Similarly, a flexible belt may be of a substantial thickness of, for example, about 250 microns, or of minimum thickness of less than about 50 microns, provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, substrates selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer in embodiments is comprised of, for example, a number of known photogenerating pigments including, for example, Type V hydroxygallium phthalocyanine, Type IV or V titanyl phthalocyanine or chlorogallium phthalocyanine, and a resin binder like poly(vinyl chloride-co-vinyl acetate) copolymer, such as VMCH (available from Dow Chemical), or polycarbonate. Generally, the photogenerating layer can contain known photogenerating pigments, such as metal phthalocyanines, metal free phthalocyanines, alkylhydroxygallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin is present in various suitable amounts of, for example, from about 1 to about 50 weight percent, and more specifically, from about 1 to about 10 weight percent, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Generally, however, from about 5 to about 90 percent by volume of the photogenerating pigment is dispersed in about 10 to about 95 percent by volume of the resinous binder, or from about 20 to about 30 percent by volume of the photogenerating pigment is dispersed in about 70 to about 80 percent by volume of the resinous binder composition. In one embodiment, about 8 percent by volume of the photogenerating pigment is dispersed in about 92 percent by volume of the resinous binder composition. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicone and compounds of silicone and germanium, carbon, oxygen, nitrogen, and the like fabricated by vacuum evaporation or deposition. The photogenerating layer may also comprise inorganic pigments of crystalline selenium and its alloys; Group II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

Examples of polymeric binder materials that can be selected as the matrix for the photogenerating layer components are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene-butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

Various suitable and conventional known processes may be selected to mix, and thereafter apply the photogenerating layer coating mixture to the substrate, and more specifically, to the hole blocking layer or other layers like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like. The coating of the photogenerating layer on the hole blocking layer in embodiments of the present disclosure can be accomplished such that the final dry thickness of the photogenerating layer is as illustrated herein, and can be, for example, from about 0.01 to about 30 microns after being dried at, for example, about 40 to about 150° C. for about 1 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. The hole blocking layer or undercoat layer (UCL) may be applied to the electrically conductive supporting substrate surface prior to the application of a photogenerating layer.

A suitable known adhesive layer can be included in the photoconductor. Typical adhesive layer materials include, for example, polyesters, polyurethanes, and the like. The adhesive layer thickness can vary, and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like. As optional adhesive layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicone nitride, carbon black, and the like, to provide, for example, in embodiments of the present disclosure, further desirable electrical and optical properties.

A number of charge transport materials, especially known hole transport molecules, may be selected for the charge transport layer, examples of which are aryl amines of the formulas/structures, and which layer is generally of a thickness of from about 5 to about 75 microns, and more specifically, of a thickness of from about 10 to about 40 microns

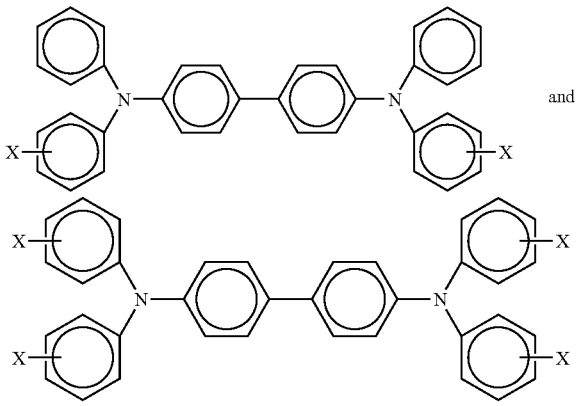

and wherein X is a suitable hydrocarbon like alkyl, alkoxy, and aryl; a halogen, or mixtures thereof, and especially those substituents selected from the group consisting of Cl and $CH_3$; and molecules of the following formulas

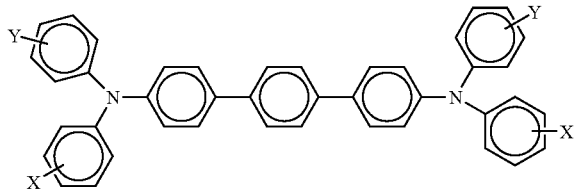

and

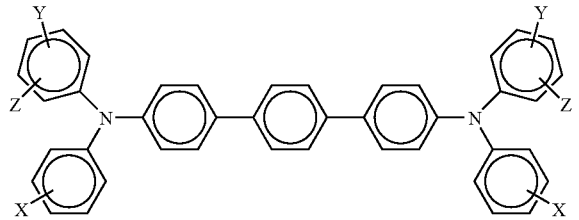

wherein X, Y and Z are a suitable substituent like a hydrocarbon, such as independently alkyl, alkoxy, or aryl; a halogen, or mixtures thereof, and wherein at least one of Y or Z is present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments. At least one charge transport refers, for example, to 1, from 1 to about 7, from 1 to about 4, and from 1 to about 2.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layer or layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly (cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules selected for the charge transport layer or layers, and present in various effective amounts, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine; hydrazones such as N-phenyl-N-methyl-3-(9-ethyl) carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5,dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material or a combination of a small molecule charge transport material and a polymeric charge transport material.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate)methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

A number of processes may be used to mix, and thereafter apply the charge transport layer or layers coating mixture to the photogenerating layer. Typical application techniques include spraying, dip coating, and roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is, for example, from about 10 to about 75 microns, from about 15 to about 50 microns, but thicknesses outside these ranges may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to about 200:1, and in some instances 400:1. The charge transport layer is substantially nonabsorbing to visible light or radiation in the region of intended use, but is electrically "active" in that it allows the injection of photogenerated holes from the photoconductive layer or photogenerating layer, and allows these holes to be transported through itself to selectively discharge a surface charge on the surface of the active layer.

The thickness of the continuous charge transport layer selected depends upon the abrasiveness of the charging (bias charging roll), cleaning (blade or web), development (brush), transfer (bias transfer roll), and the like in the system employed, and can be up to about 10 microns. In embodiments, the thickness for each charge transport layer can be, for example, from about 1 to about 5 microns. Various suitable and conventional methods may be used to mix, and thereafter apply an overcoat top charge transport layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging, and should not have too high a free carrier concentration. Free carrier concentration in the overcoat increases the dark decay.

The following Examples are provided. All proportions are by weight unless otherwise indicated.

COMPARATIVE EXAMPLE 1

A dispersion of a hole blocking layer was prepared by milling 18 grams of $TiO_2$ (MT-150W, manufactured by Tayca Co., Japan), 24 grams of the phenolic resin (VARCUM® 29159, OxyChem Co., about 50 percent in xylene/1-butanol=50/50) at a solid weight ratio of about 60 to about 40 in a solvent mixture of xylene and 1-butanol (50/50 mixture), and a total solid content of about 48 percent in an attritor mill with about 0.4 to about 0.6 millimeter size $ZrO_2$ beads for 6.5 hours, and then filtering with a 20 micron Nylon filter. A 30 millimeter aluminum drum substrate was then coated with the aforementioned generated dispersion using known coating techniques as illustrated herein. After drying at 160° C. for 20 minutes, a hole blocking layer of $TiO_2$ in the phenolic resin ($TiO_2$/phenolic resin=60/40) about 15 microns in thickness was obtained.

A photogenerating layer comprising chlorogallium phthalocyanine (Type C) was deposited on the above hole blocking layer or undercoat layer at a thickness of about 0.2 micron. The photogenerating layer coating dispersion was prepared as follows. 2.7 Grams of chlorogallium phthalocyanine (ClGaPc) Type C pigment were mixed with 2.3 grams of the polymeric binder (carboxyl modified vinyl copolymer, VMCH, Dow Chemical Company), 15 grams of n-butyl acetate, and 30 grams of xylene. The resulting mixture was milled in an attritor mill with about 200 grams of 1 millimeter Hi-Bea borosilicate glass beads for about 3 hours. The dispersion mixture obtained was then filtered through a 20 micron Nylon cloth filter, and the solids content of the dispersion was diluted to about 6 weight percent.

Subsequently, a 29 micron (A) or 15 micron (B) charge transport layer was coated on top of the photogenerating layer from a dispersion prepared from N,N'-diphenyl-N,N-bis(3-methylphenyl)-1,1'-biphenyl-4,4'-diamine (5.38 grams), a film forming polymer binder, PCZ-400 [poly(4,4'-dihydroxydiphenyl-1-1-cyclohexane, $M_w$=40,000)] available from Mitsubishi Gas Chemical Company, Ltd. (7.13 grams), and PTFE POLYFLON™ L-2 microparticle (1 gram), available from Daikin Industries, dissolved/dispersed in a solvent mixture of 20 grams of tetrahydrofuran (THF), and 6.7 grams of toluene through a CAVIPRO™ 300 nanomizer (Five Star Technology, Cleveland, Ohio). The charge transport layer was dried at about 120° C. for about 40 minutes.

EXAMPLE I

Two photoconductors (A) and (B) were prepared by repeating the process of Comparative Example 1 (A) and 1 (B), respectively, except that the hole blocking layer dispersion was prepared by milling 19.5 grams of $TiO_2$ (MT-150W, manufactured by Tayca Co., Japan), 7 grams of the epoxy resin (EPON™ 1001-T-75, 450 to 550 weight per epoxide, 75 percent solids in toluene, obtained from HEXION Specialty Chemicals), and 9.46 grams of the carboxyl resin (PARALOID® AT-81, $T_g$=40° C., acid number=65, 55.5 percent solid in the aromatic solvent 150/butyl cellusolve=87/13, obtained from Rohm and Haas) at a solid weight ratio of about 65 to about 17.5 to about 17.5 in a solvent mixture of xylene and 1-butanol (50/50 mixture), and a total solid content of about 45 percent in an attritor mill with about 0.4 to about 0.6 millimeter size $ZrO_2$ beads for 6.5 hours, and then filtering with a 20 micron Nylon filter. The resulting dispersion was then added to 0.3 gram of the base catalyst, triethylamine, and mixed for an hour. A 30 millimeter aluminum drum substrate was then coated with the aforementioned generated dispersion using known coating techniques as illustrated herein. After drying at 180° C. for 20 minutes, a hole blocking layer of $TiO_2$ in the crosslinked epoxy/carboxyl resin mixture ($TiO_2$/epoxy resin/carboxyl resin=65/17.5/17.5) about 15 microns in thickness was obtained.

EXAMPLE II

Two photoconductors (A) and (B) were prepared by repeating the process of Example I (A) and I (B), respectively, except that the hole blocking layer was dried at 200° C. for 20 minutes.

EXAMPLE III

Two photoconductors (A) and (B) were prepared by repeating the process of Comparative Example 1 (A) and 1 (B), respectively, except that the hole blocking layer dispersion was prepared by milling 19.5 grams of $TiO_2$ (MT-150W, manufactured by Tayca Co., Japan), 4.2 grams of the epoxy resin (EPON™ 1001-T-75, 450 to 550 weight per epoxide, 75 percent solids in toluene, obtained from HEXION Specialty Chemicals), and 13.24 grams of the carboxyl resin (PARALOID® AT-81, $T_g$=40° C., acid number=65, 55.5 percent solid in the aromatic solvent 150/butyl cellusolve=87/13, obtained from Rohm and Haas) at a solid weight ratio of about 65 to about 10.5 to about 24.5 in a solvent mixture of xylene and 1-butanol (50/50 mixture), and a total solid content of about 45 percent in an attritor mill with about 0.4 to about 0.6 millimeter size $ZrO_2$ beads for 6.5 hours, and then filtering with a 20 micron Nylon filter. The dispersion was then added with 0.3 gram of the base catalyst, triethylamine, and mixed for an hour. A 30 millimeter aluminum drum substrate was then coated with the aforementioned generated dispersion using known coating techniques as illustrated herein. After drying at 180° C. for 20 minutes, a hole blocking layer of $TiO_2$ in the epoxy/carboxyl resin mixture ($TiO_2$/epoxy resin/carboxyl resin=65/10.5/24.5) about 15 microns in thickness was obtained.

EXAMPLE IV

Two photoconductors (A) and (B) were prepared by repeating the process of Example III (A) and III (B), respectively, except that the hole blocking layer was dried at 200° C. for 20 minutes.

ELECTRICAL PROPERTY TESTING

The above prepared photoconductors of Comparative Example 1 (A) and Examples I (A), II (A), III (A) and IV (A) were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. These two photoconductors were tested at surface potentials of 700 volts with the exposure light intensity incrementally increased by regulating a series of neutral density filters; the exposure light source is a 780 nanometer light emitting diode. The xerographic simulation was completed in an environmentally controlled light tight chamber at ambient conditions (40 percent relative humidity and 22° C.).

The $V_r$ (residual potential after erase) was used to characterize the photoconductors with the results being shown in Table 1. The disclosed photoconductors of Examples I (A), II (A), III (A) and IV (A) exhibited about 30 to about 50 volts lower $V_r$ than the photoconductor of Comparative Example 1 (A).

TABLE 1

| Photoconductors | $V_r$ (V) |
|---|---|
| Comparative Example 1 (A) | 116 |
| Example I (A) | 101 |
| Example II (A) | 124 |

TABLE 1-continued

| Photoconductors | $V_r$ (V) |
|---|---|
| Example III (A) | 124 |
| Example IV (A) | 150 |

GHOSTING MEASUREMENT

The Comparative Example 1 (A) and Examples I (A), II (A), III (A) and IV (A) photoconductors were acclimated at room temperature for 24 hours before testing in A zone (85° F. and 80 percent humidity) for ghosting. Print testing was accomplished in the Xerox Corporation WorkCentre™ Pro C3545 using the K (black toner) station at t of 500 print counts (t equal to 0 is the first print; t equal to 500 is the $500^{th}$ print). At the CMY stations of the color WorkCentre™ Pro C3545, run-up from t of 0 to t of 500 print counts for the photoconductor was completed. The prints for determining ghosting characteristics includes an X symbol or letter on a half tone image. When X is visible, the ghost level is assigned Grade 0; when X is barely visible, the ghost level is assigned Grade 1; Grade 2 to Grade 5 refers to the level of visibility of X with Grade 5 meaning a dark and visible X. Ghosting levels were visually measured against an empirical scale, the smaller the ghosting grade (absolute value), the better the print quality. The ghosting results are summarized in Table 2.

TABLE 2

| Photoconductors | Ghosting Grade at t of 0 | Ghosting at t of 500 prints |
|---|---|---|
| Comparative Example 1 (A) | Grade −3 | Grade −5 |
| Example I (A) | Grade 0 | Grade −1 |
| Example II (A) | Grade 0 | Grade −1.5 |
| Example III (A) | Grade −1 | Grade −1.5 |
| Example IV (A) | Grade −1 | Grade −1.5 |

After 500 prints, the ghosting level for the Example photoconductors remained low at Grade −1 to −1.5; in contrast, the Comparative Example 1 (A) photoconductor had an elevated ghosting level of Grade −5. The disclosed hole blocking layer comprised of the epoxy/carboxyl resin mixture exhibited almost no ghosting; in contrast, the Comparative hole blocking layer comprised of the phenolic resin exhibited high ghosting.

BACKGROUND/CHARGE DEFICIENT SPOT MEASUREMENT

The Comparative Example 1 (B) and Examples I (B), II (B), III (B) and IV (B) photoconductors were acclimated at room temperature for 24 hours before testing in A zone (85° F./80 percent relative humidity) for background/charge deficient spot (CDS). Print testing was completed in the Xerox Corporation WorkCentre™ Pro C3545 using the black and white copy mode, and where there was achieved a machine speed of 165 millimeters/second at t equal to 0 for background/CDS. Background/CDS levels were visually measured against an empirical scale where the smaller the background/CDS grade level, the better the print quality. The results are shown in Table 3. More specifically, background/CDS is a measure of the percentage of grayness on white paper; Grade 1, on this scale, is almost white, while Grade 2 represents unacceptable dark prints.

TABLE 3

| Photoconductors | Background/CDS Grade |
|---|---|
| Comparative Example 1 (A) | Grade 2 |
| Example I (A) | Grade 1 |
| Example II (A) | Grade 1 |
| Example III (A) | Grade 1 |
| Example IV (A) | Grade 1 |

The photoconductors that contain the disclosed hole blocking layer comprised of the epoxy/carboxyl resin mixture exhibited almost no background/CDS, while in contrast, the Comparative hole blocking layer comprised of the phenolic resin exhibited 100 percent higher background/CDS.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor consisting of a substrate; an undercoat layer thereover wherein the undercoat layer consists of a metal oxide, and a mixture that consists of an epoxy resin and a carboxyl resin; a photogenerating layer; and at least one aryl amine charge transport layer; and wherein said epoxy resin possesses a weight average molecular weight of from about 60 to about 30,000, and said carboxyl resin possesses a weight average molecular weight of from about 500 to about 100,000 and wherein said resin mixture is present in an amount of from about 20 to about 60 weight percent, and wherein the total of said components in said undercoat layer is about 100 percent; wherein said mixture of the epoxy resin and the carboxyl resin is crosslinked by the use of a catalyst.

2. A photoconductor in accordance with claim 1 wherein said metal oxide is a titanium oxide.

3. A photoconductor in accordance with claim 1 wherein said metal oxide is present in an amount of from about 20 percent to about 80 percent by weight of the total weight of the undercoat layer components.

4. A photoconductor in accordance with claim 1 wherein said resin mixture is present in said undercoat layer in an amount of from about 20 to about 50 weight percent.

5. A photoconductor in accordance with claim 1 wherein said epoxy resin is present in said resin mixture in an amount of from about 1 to about 99 weight percent, and said carboxyl resin is present in said resin mixture in an amount of from about 99 to about 1 weight percent, and wherein the total resin mixture thereof is about 100 percent.

6. A photoconductor in accordance with claim 1 wherein said epoxy resin is selected from the group consisting of diglycidyl ether of bisphenol A epoxy resin, diglycidyl ether of bisphenol F epoxy resin, tetraglycidyl ether of tetraphenol ethane epoxy resin, epoxy phenolic novolac resin, epoxy bisphenol A novolac resin, epoxy bisphenol F novolac resin, epoxy cresol novolac resin, epoxy polyacrylate, elastomer modified epoxy resin, hydrogenated diglycidyl ether of bisphenol A epoxy resin, cycloaliphatic glycidyl ether epoxy resin, brominated epoxy, alkyl glycidyl ether epoxy resin, cresyl glycidyl ether epoxy resin, butyl glycidyl ether epoxy resin, castor oil glycidyl ether epoxy resin, and optionally mixtures thereof.

7. A photoconductor in accordance with claim 1 wherein said epoxy resin is a diglycidyl ether of bisphenol A epoxy resin and a diglycidyl ether of bisphenol F epoxy resin, and mixtures thereof.

8. A photoconductor in accordance with claim 1 wherein said crosslinking is from about 60 to about 95 percent.

9. A photoconductor in accordance with claim 1 wherein said catalyst is an acid selected from a group consisting of oxalic acid, maleic acid, carboxylic acid, ascorbic acid, malonic acid, succinic acid, tartaric acid, citric acid, p-toluenesulfonic acid, methanesulfonic acid, and mixtures thereof, present in an amount of from about 0.1 to about 5 weight percent based on the total weight of said resin mixture; or a base selected from a group consisting of triethyl amine, diethylenetriamine, triethylenetetramine, isphoronediamine, bis-p-aminocyclo hexylmethane, 1,2-diaminocyclohexane, diaminodiphenylmethane, and mixtures thereof, present in an amount of from about 0.1 to about 10 weight percent based on the total weight of said resin mixture.

10. A photoconductor in accordance with claim 1 wherein said metal oxide is present in an amount of from about 50 percent to about 70 percent based on the total weight of the undercoat layer components.

11. A photoconductor in accordance with claim 1 wherein said metal oxide possesses a size diameter of from about 5 to about 300 nanometers, and a powder resistivity of from about $1\times10^3$ to about $1\times10^8$ ohm/cm when applied at a pressure of from about 50 to about 650 kilograms/cm$^2$.

12. A photoconductor in accordance with claim 1 wherein said metal oxide is surface treated with aluminum laurate, alumina, zirconia, silica, silane, methicone, dimethicone, sodium metaphosphate or mixtures thereof.

13. A photoconductor in accordance with claim 1 wherein said metal oxide is a titanium oxide surface treated with an alkali metaphosphate.

14. A photoconductor in accordance with claim 1 wherein the thickness of the undercoat layer is from about 0.1 micron to about 30 microns.

15. A photoconductor in accordance with claim 1 wherein the thickness of the undercoat layer is from about 1 micron to about 15 microns, and said metal oxide is titanium oxide, zinc oxide or tin oxide.

16. A photoconductor in accordance with claim 1 wherein said charge transport layer is comprised of at least one of

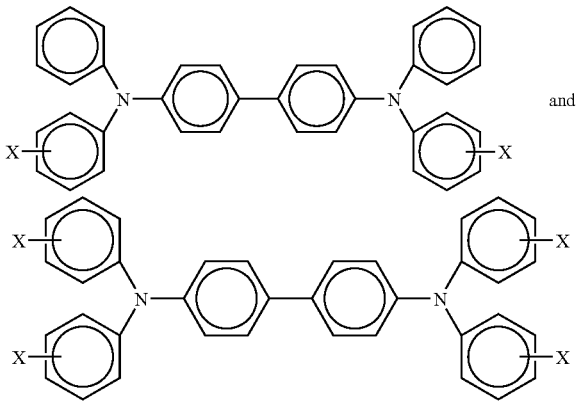

and wherein X is selected from the group consisting of alkyl, alkoxy, aryl, and halogen, and mixtures thereof.

17. A photoconductor in accordance with claim 1 wherein said charge transport layer consists of at least one of

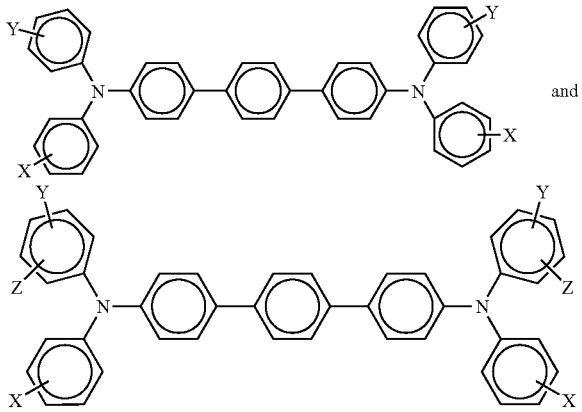

and wherein X, Y, and Z are independently selected from the group consisting of alkyl, alkoxy, aryl, and halogen, and mixtures thereof; wherein said epoxy resin is selected from the group consisting of diglycidyl ether of bisphenol A epoxy resin, diglycidyl ether of bisphenol F epoxy resin, tetraglycidyl ether of tetraphenol ethane epoxy resin, epoxy phenolic novolac resin, epoxy bisphenol A novolac resin, epoxy bisphenol F novolac resin, epoxy cresol novolac resin, epoxy polyacrylate, elastomer modified epoxy resin, hydrogenated diglycidyl ether of bisphenol A epoxy resin, cycloaliphatic glycidyl ether epoxy resin, brominated epoxy, alkyl glycidyl ether epoxy resin, cresyl glycidyl ether epoxy resin, butyl glycidyl ether epoxy resin, castor oil glycidyl ether epoxy resin, and optionally mixtures thereof; and wherein said carboxyl resin is an acrylic carboxyl resin polymerized from acrylic acid, methacrylic acid, and their derivatives, and mixtures thereof.

18. A photoconductor in accordance with claim 1 wherein said charge transport layer is comprised of a component selected from the group consisting of N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

19. A photoconductor in accordance with claim 1 wherein said photogenerating layer is comprised of at least one photogenerating pigment.

20. A photoconductor in accordance with claim 19 wherein said photogenerating pigment is comprised of at least one of a titanyl phthalocyanine, a hydroxygallium phthalocyanine, a halogallium phthalocyanine, and mixtures thereof.

21. A photoconductor in accordance with claim 1 wherein said at least one charge transport layer is from 1 to about 4 layers.

22. A photoconductor in accordance with claim 1 wherein said at least one charge transport layer consists of a charge transport component and a resin binder; wherein said photogenerating layer consists of at least one photogenerating pigment and a resin binder; and wherein said photogenerating layer is situated between said substrate and said charge transport layer, and wherein said epoxy resin possesses a weight average molecular weight of from about 500 to about 3,000, and said carboxyl resin possesses a weight average molecular weight of from about 1,500 to about 20,000.

23. A photoconductor consisting of a substrate; an undercoat layer thereover consisting of a mixture consisting of a metal oxide, and a crosslinked mixture of a crosslinked epoxy resin and a carboxyl resin; a photogenerating layer; and a charge transport layer, wherein said resin mixture is present in an amount of from about 20 to about 60 weight percent, wherein the total of said components in said undercoat layer is about 100 percent, wherein said epoxy resin is present in said resin mixture in an amount of from about 10 to about 40 weight percent, and said carboxyl resin is present in said resin mixture in an amount of from about 90 to about 60 weight percent, and wherein the total resin mixture solids thereof is about 100 percent; and wherein said epoxy resin possesses a weight average molecular weight of from about 250 to about 12,000, and said carboxyl resin possesses a weight average molecular weight of from about 1,500 to about 20,000.

24. A rigid or flexible photoconductor consisting of in sequence a supporting substrate; a hole blocking layer of a titanium oxide, and a mixture consisting of an epoxy resin and a carboxyl resin: a photogenerating layer, and a charge transport layer; and wherein the mixture is crosslinked at a percentage of from about 60 to about 95 percent, and which crosslinking is accomplished with a catalyst, and wherein said epoxy resin is a diglycidyl ether of bisphenol A epoxy resin, a diglycidyl ether of bisphenol F epoxy resin, and mixtures thereof; wherein said catalyst is an acid selected from a group consisting of oxalic acid, maleic acid, carboxylic acid, ascorbic acid, malonic acid, succinic acid, tartaric acid, citric acid, p-toluenesulfonic acid, methanesulfonic acid, and mixtures thereof, present in an amount of from about 0.1 to about 5 weight percent based on the total weight of said resin mixture; or a base selected from a group consisting of triethyl amine, diethylenetriamine, triethylenetetramine, isphoronediamine, bis-p-aminocyclo hexylmethane, 1,2-diaminocyclohexane, diaminodiphenylmethane, and mixtures thereof, present in an amount of from about 0.1 to about 10 weight percent based on the total weight of said resin mixture, and wherein said carboxyl resin is an acrylic carboxyl resin and wherein said epoxy resin possesses a weight average molecular weight of from about 60 to about 30,000, and said carboxyl resin possesses a weight average molecular weight of from about 1,500 to about 20,000.

25. A photoconductor in accordance with claim 23 wherein said epoxy resin is selected from the group consisting of diglycidyl ether of bisphenol A epoxy resin, diglycidyl ether of bisphenol F epoxy resin, tetraglycidyl ether of tetraphenol ethane epoxy resin, epoxy phenolic novolac resin, epoxy bisphenol A novolac resin, epoxy bisphenol F novolac resin, epoxy cresol novolac resin, epoxy polyacrylate, elastomer modified epoxy resin, hydrogenated diglycidyl ether of bisphenol A epoxy resin, cycloaliphatic glycidyl ether epoxy resin, brominated epoxy, alkyl glycidyl ether epoxy resin, cresyl glycidyl ether epoxy resin, butyl glycidyl ether epoxy resin, and castor oil glycidyl ether epoxy resin.

* * * * *